US007367091B2

(12) United States Patent
McWattie et al.

(10) Patent No.: US 7,367,091 B2
(45) Date of Patent: May 6, 2008

(54) ATTACHMENT DEVICE FOR ATTACHING A LIFTING SLING TO A HOIST

(75) Inventors: Nathan McWattie, Gotherington (GB); Phillip Hollingworth, Mid Levels (HK); John Gardener, Banbury (GB)

(73) Assignee: Joerns Healthcare Inc., Stevens Point, WI (US)

( * ) Notice: Subject to any disclaimer, the term of this patent is extended or adjusted under 35 U.S.C. 154(b) by 229 days.

(21) Appl. No.: 11/245,932

(22) Filed: Oct. 7, 2005

(65) Prior Publication Data

US 2006/0080774 A1 Apr. 20, 2006

(30) Foreign Application Priority Data

Oct. 14, 2004 (GB) ..... 0422790.6

(51) Int. Cl.
*A44B 11/10* (2006.01)

(52) U.S. Cl. ..... 24/194; 24/196

(58) Field of Classification Search ..... 5/89.1, 5/81.1 R, 83.1, 85.1, 86.1, 87.1; 24/196, 24/194, 171, 308, 115 G; 297/74
See application file for complete search history.

(56) References Cited

U.S. PATENT DOCUMENTS

| | | | | | |
|---|---|---|---|---|---|
| 987,576 | A | * | 3/1911 | Kerngood | 24/194 |
| 1,055,009 | A | * | 3/1913 | Wright | 24/194 |
| 1,212,328 | A | * | 1/1917 | Cote | 24/196 |
| 1,929,158 | A | * | 10/1933 | White et al. | 24/321 |
| 4,484,379 | A | * | 11/1984 | Appelt et al. | 24/197 |
| 4,712,257 | A | | 12/1987 | James | |

FOREIGN PATENT DOCUMENTS

| | | | |
|---|---|---|---|
| EP | 1440676 | A1 | 7/2004 |
| EP | 1440676 | A1 * | 7/2004 |
| GB | 2293857 | A | 4/1996 |
| GB | 2302561 | A * | 1/1997 |
| GB | 2352471 | A | 1/2001 |

* cited by examiner

*Primary Examiner*—Patricia Engle
*Assistant Examiner*—Bill Kelleher
(74) *Attorney, Agent, or Firm*—MacMillan, Sobanski & Todd, LLC

(57) ABSTRACT

An attachment device for attaching a sling to a hoist by engaging with an attachment formation on the hoist comprises first and second elements disposed in face to face relationship with one another and moveable relative to one another between first and second positions. The first element comprises a slot having a first portion through which the head of an attachment formation will pass and a second portion extending from the first portion and through which the body of the attachment portion can pass but through which the head will not pass. The second element has an opening through which the head of the attachment formation can pass and which aligns with the first portion of the slot in the first element when the first and second elements are in their first relative position and which aligns with the second portion of the slot when the first and second elements are in their second relative position, in which position the second element blocks the first portion of the slot in the first element.

13 Claims, 6 Drawing Sheets

ATTACHMENT DEVICE FOR ATTACHING A LIFTING SLING TO A HOIST

CROSS REFERENCE TO RELATED APPLICATIONS

This application claims the benefit of U.K. Patent Application No. 0422790.6, filed on Oct. 14, 2004.

BACKGROUND OF INVENTION

This invention relates to an attachment device for attaching a lifting sling to a hoist. The lifting sling is used to lift and support a person, such as an invalid or patient.

A lifting sling is usually attached to a hoist by providing the sling with a number of elongate flexible connecting elements, which are each at one end secured to a flexible sheet material from which the sling is made, and at another end provided with an attachment device for engagement with an attachment formation on the hoist. The flexible connecting elements may be flexible strap elements made of a woven textile tape, or length of webbing, of sufficient strength to carry a load to which the sling is likely to be subjected in use. There may be two such connecting elements and attachment devices, one at each side of the sling in a region thereof which is in the vicinity of the shoulders of a person being supported by the sling in use, and further two such connecting elements and attachment devices may be provided at respective parts of the sling that lie in the lower torso or upper leg region of a person supported by the sling, in use.

It is known that each of the attachment formations on the hoist (usually on a load-carrying cradle carried by the hoist) can comprise a headed stud, and each attachment device engageable therewith can comprise a keyhole slot or the like, having a first portion through which the head of the stud can pass and a second portion which can be entered by a body part of the headed stud after the head has been passed through the first portion, but through which the head of the stud cannot pass. When a part of the weight of a person is being carried by such an attachment device, the body of the headed stud is held in the second portion of the opening so that the attachment device cannot come off the stud. It has also been proposed that various locking or latching devices cannot be provided in association with such an attachment device, to provide greater security against unintentional disengagement of the attachment device from the headed stud.

What is needed is an improved form of attachment device for engagement with an attachment formation in the form of a headed stud, which not only provides a high degree of resistance to unintentional disengagement but also provides a clearly-visible indication as to when it is correctly engaged and thus, offers the maximum resistance to unintentional disconnection.

SUMMARY OF INVENTION

The present invention relates to an attachment device that meets the foregoing needs. The attachment device is provided for attaching a sling to a hoist by engaging with an attachment formation on the hoist, wherein the attachment formation comprises a body part and enlarged head. The attachment device is adapted to have a sling-connecting element attached thereto and comprises first and second elements disposed in face to face relationship with one another and moveable relative to one another between first and second positions. The first element comprises a slot having a first portion through which the head of the attachment formation will pass and a second portion extending from the first portion and through which the body of the attachment portion can pass but through which the head will not pass. The second element has an opening through which the head of the attachment formation can pass and which aligns with the first portion of the slot in the first element when the first and second elements are in their first relative position and which aligns with the second portion of the slot when the first and second elements are in their second relative position, in which position the second element blocks the first portion of the slot in the first element. The first and second elements have formations which are able to receive a retaining element when the first and second elements are in their second relative position to hold them in such position.

Various objects and advantages of this invention will become apparent to those skilled in the art from the following detailed description of the preferred embodiment, when read in light of the accompanying drawings.

BRIEF DESCRIPTION OF DRAWINGS

The invention will now be described by way of example with reference to the accompanying drawings, of which

DETAILED DESCRIPTION OF THE INVENTION

Figure 2:
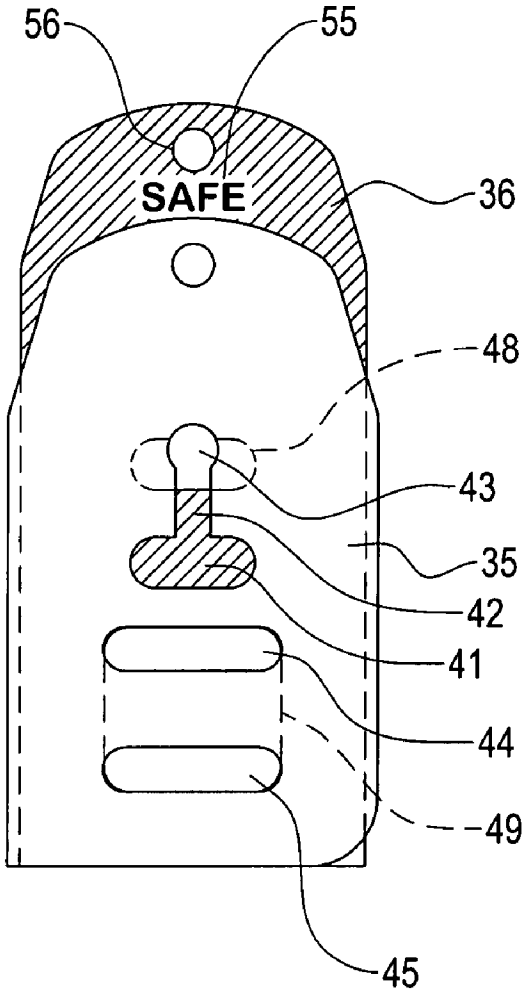
FIG. 2 is a view as FIG. 1, but in a second operative position.
Figure 1:
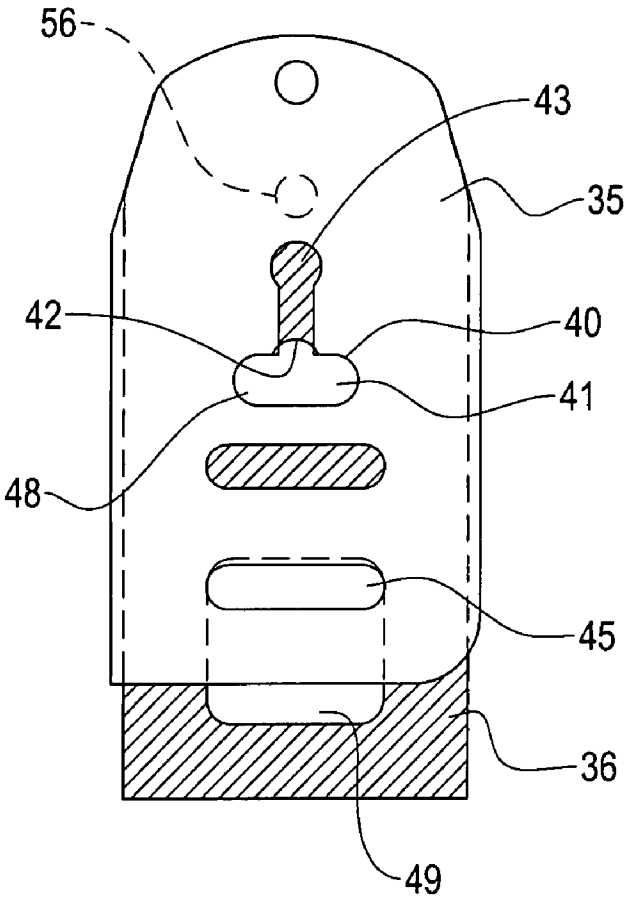
FIG. 1 is a side view of an attachment device in accordance with one embodiment of the invention, in a first operative position.
Figure 3A:
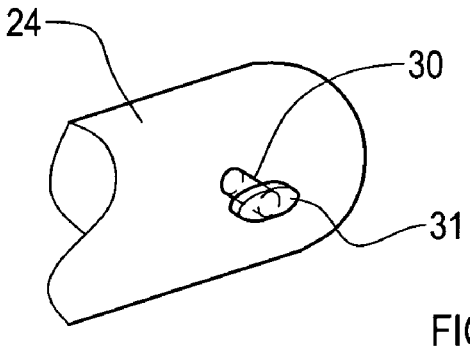
FIGS. 3*a* and 3*b* respectively illustrate an attachment formation and the attachment device.
Figure 3B:
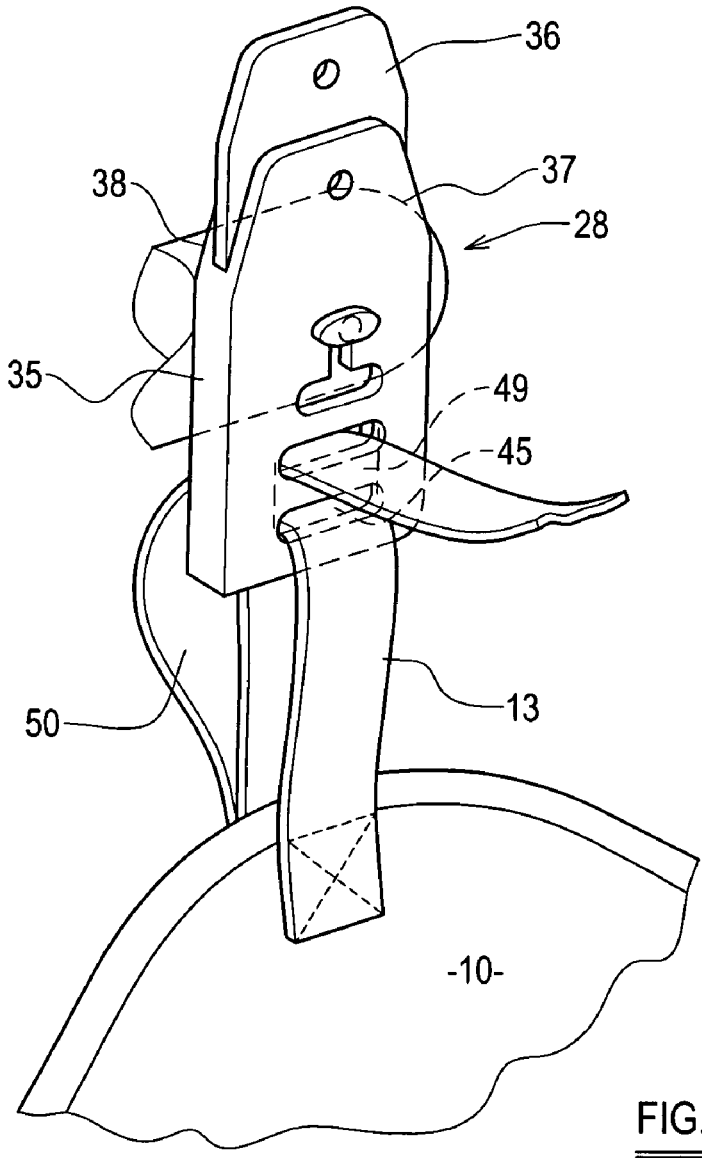
Figure 4:
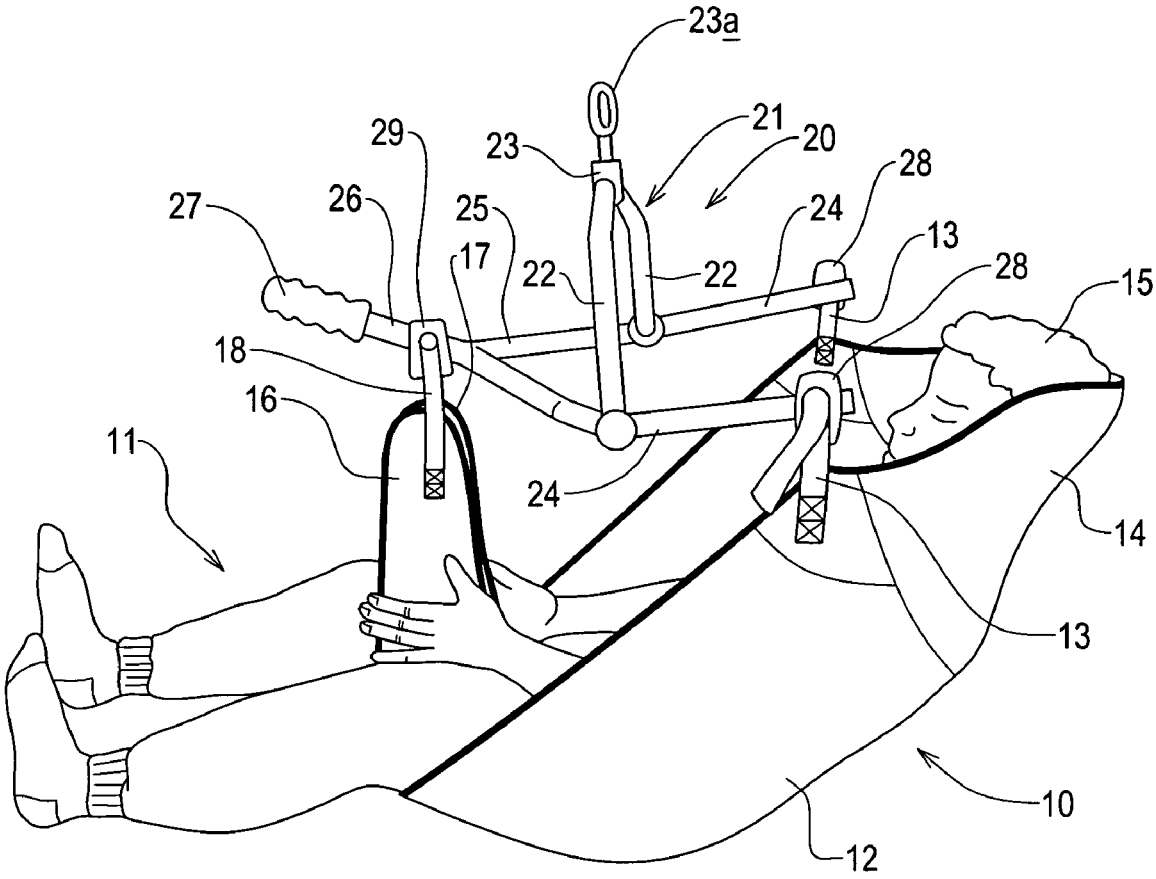
FIG. 4 illustrates a lifting sling connected to a part of an invalid hoist using attachment devices in accordance with the invention.

Referring now to FIGS. 1, 2 and 3*b* of the drawings, there is shown an attachment device that is intended for use to connect a lifting sling to a hoist, such as an invalid hoist, in the manner shown in FIG. 4. FIG. 4 shows a sling indicated generally at 10, which is made of a flexible sheet material, such as a woven fabric of sufficient strength to carry the loads to which it is to be subjected in use. Alternatively, the sling 10 or part thereof may be of a netting material, or may comprise two or more layers of material with a padding material therebetween. The sling 10 is illustrated with a person 11 (e.g., a patient) supported therein and the sling 10 comprises a part 12 which supports the torso of the person 11. The part 12 of the sling 10 is provided, in the vicinity of the shoulders of the person 11, with laterally spaced connecting elements 13, which may be in the form of straps or tapes made of a suitably strong flexible material (e.g., a webbing material made of an artificial fiber). The connecting elements 13 are sewn to the material of which the sling 10 is made. Beyond the regions where the connecting elements 13 are attached to the sling 10, the sling 10 has a head support portion 14 for supporting the head 15 of the person 11.

The main part 12 of the sling 10 extends to a region generally beneath the lower torso/upper legs of the person 11, and then is bifurcated to afford two elongate leg-support portions 16, 17 which are passed beneath the respective upper legs/thighs of the person 11 and upwardly between the legs to the illustrated position. Each of the leg-support portions 16, 17 may be provided at its end with a flexible connecting element like the connecting elements 13. Such a connecting element is indicated at 18 at the end of the leg support portion 16.

The sling 10 may be made from one or more pieces of the flexible sheet material, cut and joined together (e.g., by stitching) to give the sling 10 a three dimensional shape which comfortably supports the person 11 held by the sling 10.

The sling 10 is arranged to be connected to the hoist by a supporting cradle, indicated generally at 20 in FIG. 4. The cradle 20 comprises a member 21, which is generally of inverted U-shape, having a pair of limbs 22 which extend outwardly and downwardly from a member 23 provided with a formation 23*a* enabling it to be connected to the jib of a hoist. Such connection may provide for pivoting of the member 21 relative to the jib of the hoist, about a generally vertical axis. The bottom ends of the limbs 22 are connected, for pivoting about a generally horizontal axis, to spaced limbs 24 of a somewhat Y-shaped carrying member 25. The spaced limbs 24 of the Y-shaped member 25, join into a single limb 26 which ends in a handle 27. The connecting elements 13 and 18 are each provided with an attachment device for engagement with attachment formations on the carrying member 25, and the attachment devices on the connecting elements 13 are indicated at 28 and that on the visible connecting element 18 is indicated at 29, all the attachment devices being the same as one another. Attachment formations on the conveying member 25, with which the attachment devices are engageable, are provided adjacent the free ends of the spaced limbs 24, facing outwardly from one another, and on opposite sides of the limb 26, all the attachment formations being the same as one another.

Referring now back to FIGS. 1 to 3*b* of the drawings, one of the attachment formations 30 on the member 25, such as that adjacent the end of one of the limbs 24, is shown in FIG. 3*a*. It comprises a headed stud with a body part 30*a* of cylindrical form, ending in a somewhat elliptical head 30*b*.

Each attachment device 28 or 29 comprises a first element 35 and a second element 36 moveable relative to the first element 35. The first element 35 may be of plastics material and may comprise spaced parallel walls 37, 38 joined at their upwardly extending (having regard to the normal orientation of the attachment device in use and in which it is illustrated in the drawings) edges to define a narrow passage extending upwardly and downwardly through the first element and in which the second element is received. The second element 36 is preferably a metal plate, although may be formed of other suitable materials.

The first element 35 has a slot 40 extending through both of its walls, from its front face to its rear face, the slot 40 having a first portion 41 through which the head 30*b* of the attachment formation 30 is able to pass through the first element 35. A second portion 42 of the slot 40 extends upwardly Thorn the portion 41, and has a closed upper end 43 of slightly enlarged width compared with the width of the portion 42 adjacent the portion 41. Beneath the portion 41 of the slot, the first element 35 has a formation, such the first aperture 44 extending through it, the aperture 44 being relatively wide but of low height, and beneath the first aperture 44 there is an aperture 45 for co-operation with the connecting element as 13 or 18.

The second element 36 is provided with an opening 48 whose shape is most clearly seen in FIG. 2 (shown in broken lines). The shape corresponds to that of the lowermost part of the slot 40, including the first portion 41 thereof and an adjacent lowermost part of the second portion 42. Beneath the opening 48, the second element 36 has a formation, such as the large generally square aperture 49.

The second element 36 is moveable relative to the first element 35 of the attachment device between a first position in which it is shown in FIG. 1 and a second position in which it is shown in FIG. 2. In the first position, the opening 48 in the second element 36 aligns with the lowermost portion of the slot 40 in the first element 35, whilst the aperture 44 in the first element 35 is blocked by the second element 36. The aperture 45 in the first element 35 lies adjacent the top of the square aperture 49 in the second element 36. In this position, the head 30*b* of the attachment formation 30 is able to be passed through the aligned opening 48 and the lower portion of slot 40.

Then the connecting element 13 and hence the first element 35 of the attachment device can be pulled downwardly relative to the second element 36 of the attachment device. The position shown in FIGS. 2 and 3*b* is attained, in which the body 30*a* of the attachment formation 30 lies in the slightly enlarged upper end 43 of the slot 40 in the second element. The remainder of the slot 40 in the second element 36 is blocked by the element 36 beneath its opening 48. The top of the square aperture 49 in the element 36 aligns with the aperture 44 in the first element 35, so that the free end of the safety retaining element 50 can be passed through the through-opening thus afforded, as shown in FIG. 3*b*. The presence of the safety retaining element 50 at least resists and preferably altogether prevents movement of the first and second elements 35, 36 from the position shown in FIGS. 2 and 3*b*. Thus the attachment device is held captive to the attachment formation 30 with disengagement therefrom impossible unless the safety retaining element 50 is firstly moved out of the aligned aperture 44, 49.

It will be noted that in this condition the aperture 45 in the first element 35 aligns with the bottom of square aperture 49 in the second element 36, so the load on the connecting element 13 is born by both the first and second elements 35, 36.

The part of the second element 36 which protrudes above the first element 35 may be provided with a visible indication of its being in that position (e.g. a noticeable color or a printed indication), such as indicated at 55 in FIG. 2, to indicate that the attachment device has reached a safely attached condition. A detent, catch or the like, as indicated at 56, may be provided operable between the first and second elements 35, 36 further to provide security against their moving from the relative position shown in FIGS. 2 and 3*b*. The safety retaining element 50 may be a bright color or otherwise be arranged to be readily noticeable when it is in position as shown in FIG. 3*b*, so the safely attached condition of the attachment device is visible at a glance.

Figure 5:
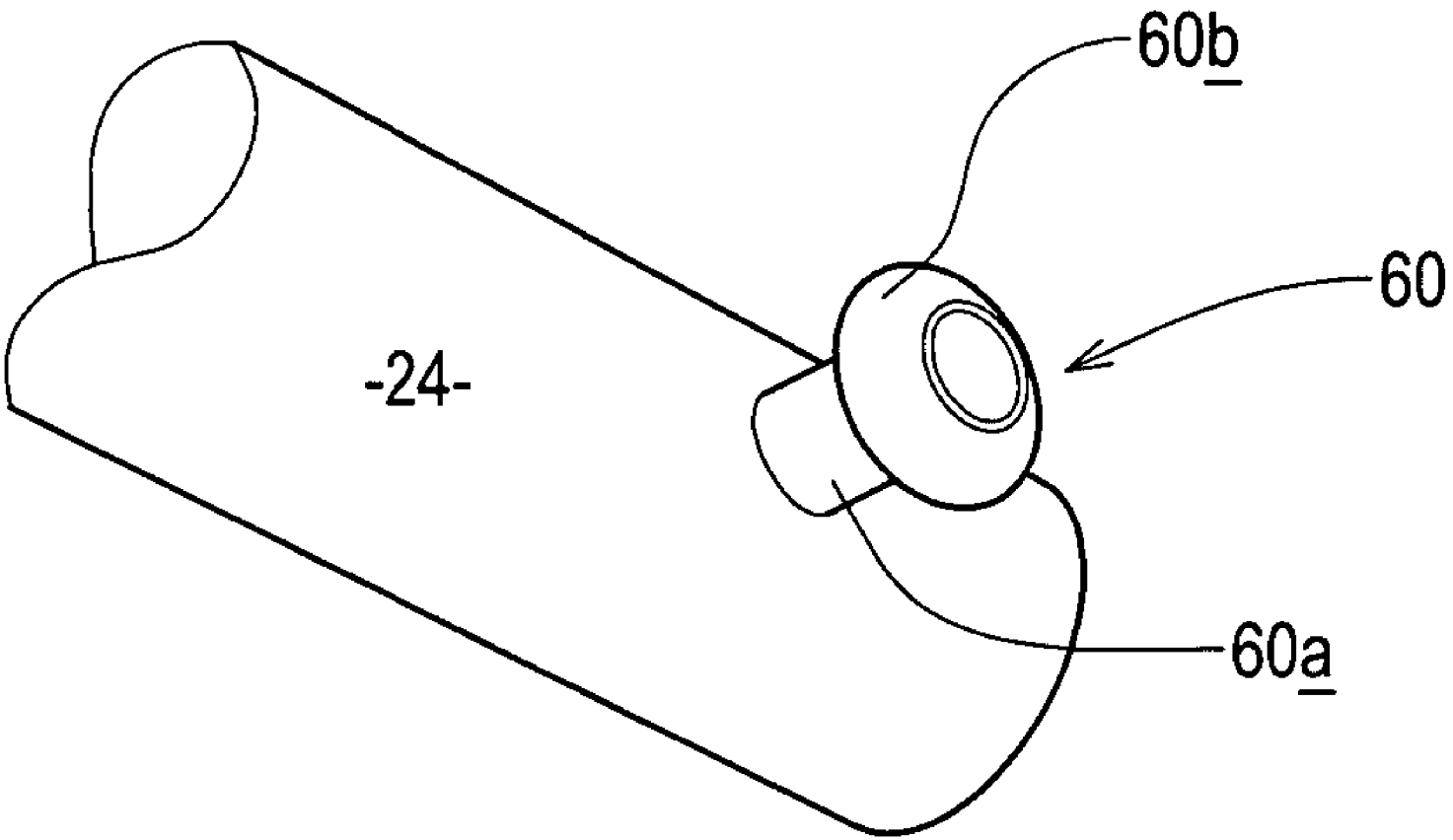
FIG. 5 illustrates an alternative attachment formation.

In FIG. 5, there is illustrated an alternative attachment formation 60 on the member 25, such as that adjacent the end of one of the limbs 24, is shown in the drawing. It comprises a headed stud with a body part 60*a* of cylindrical form, ending in a somewhat cylindrical head 60*b*.

An alternative attachment device 61 comprises a first element 62 and a second element 63 moveable relative to the first element 62. The first element 62 may be of plastics material and may comprise spaced parallel walls 64, 65 joined at their upwardly extending (having regard to the normal orientation of the attachment device in use and in which it is illustrated in the drawings) edges to define a narrow passage extending upwardly and downwardly through the first element and in which the second element is received. The second element 63 is preferably a metal plate, although may be formed of other suitable materials.

The first element 62 has a slot 66 extending through both of its walls, from its front face to its rear face, the slot 66 having a first portion 67 through which the head 60*b* of the attachment formation 60 is able to pass through the first element 62. A second portion 68 of the slot 66 extends upwardly from the portion 67, and has a closed upper end 69. The slot portion 67 has lateral extensions to Loan a formation, such as the first aperture 70 extending through the first element 62, and beneath the first aperture 70 there is an aperture 71 for co-operation with the connecting element as 13 or 18.

Figure 7:
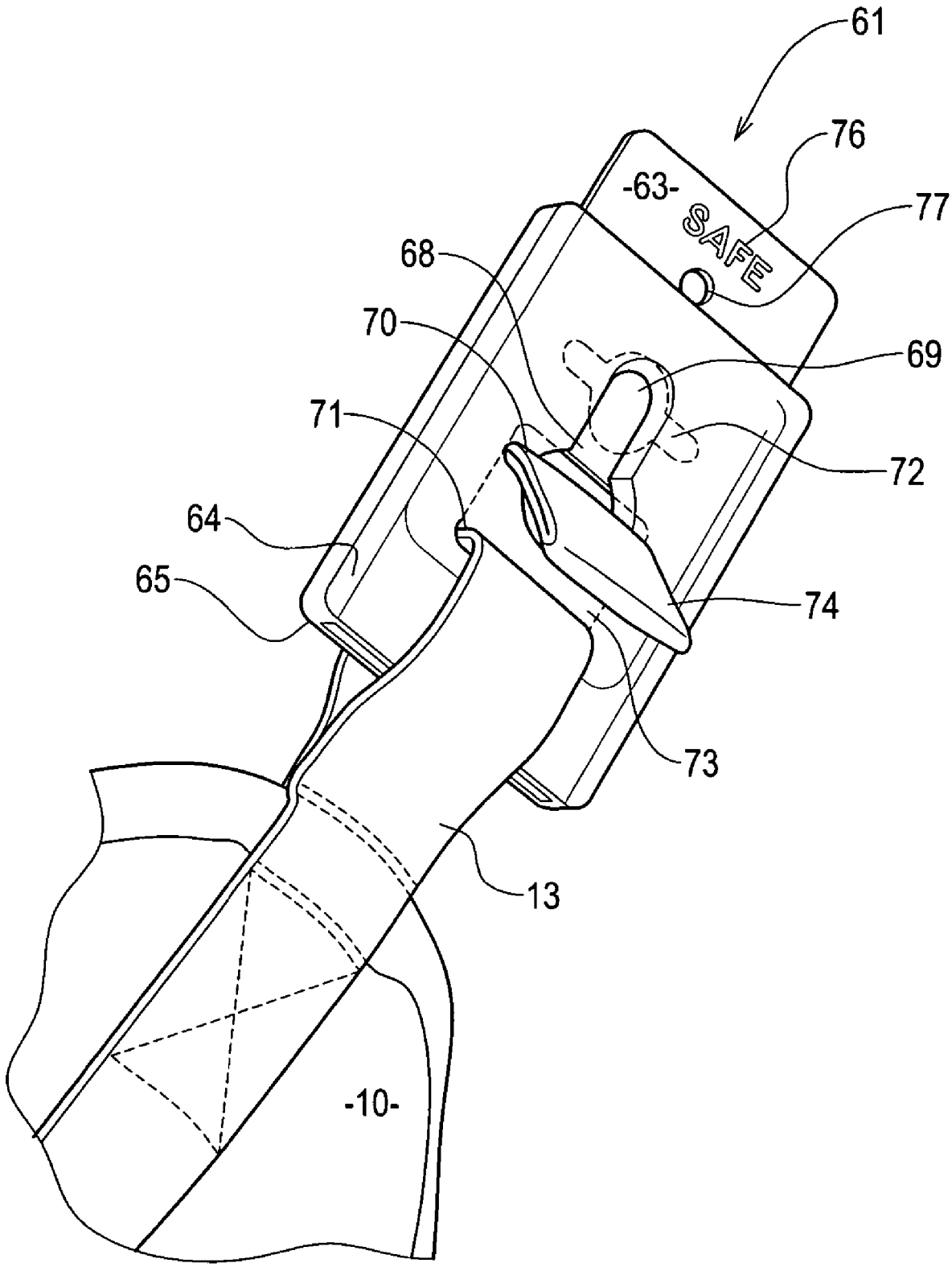
FIG. 7 is a view as FIG. 6, but in a second operative position.

The second element 63 is provided with an opening 72 whose shape is most clearly seen in FIG. 7 (shown in broken lines). The shape corresponds to that of the lowermost part of the slot 66, including the first portion 67 thereof and an adjacent lowermost part of the second portion 68. Beneath the opening 72, the second element 63 has a formation, such as the large generally square aperture 73.

Figure 6:
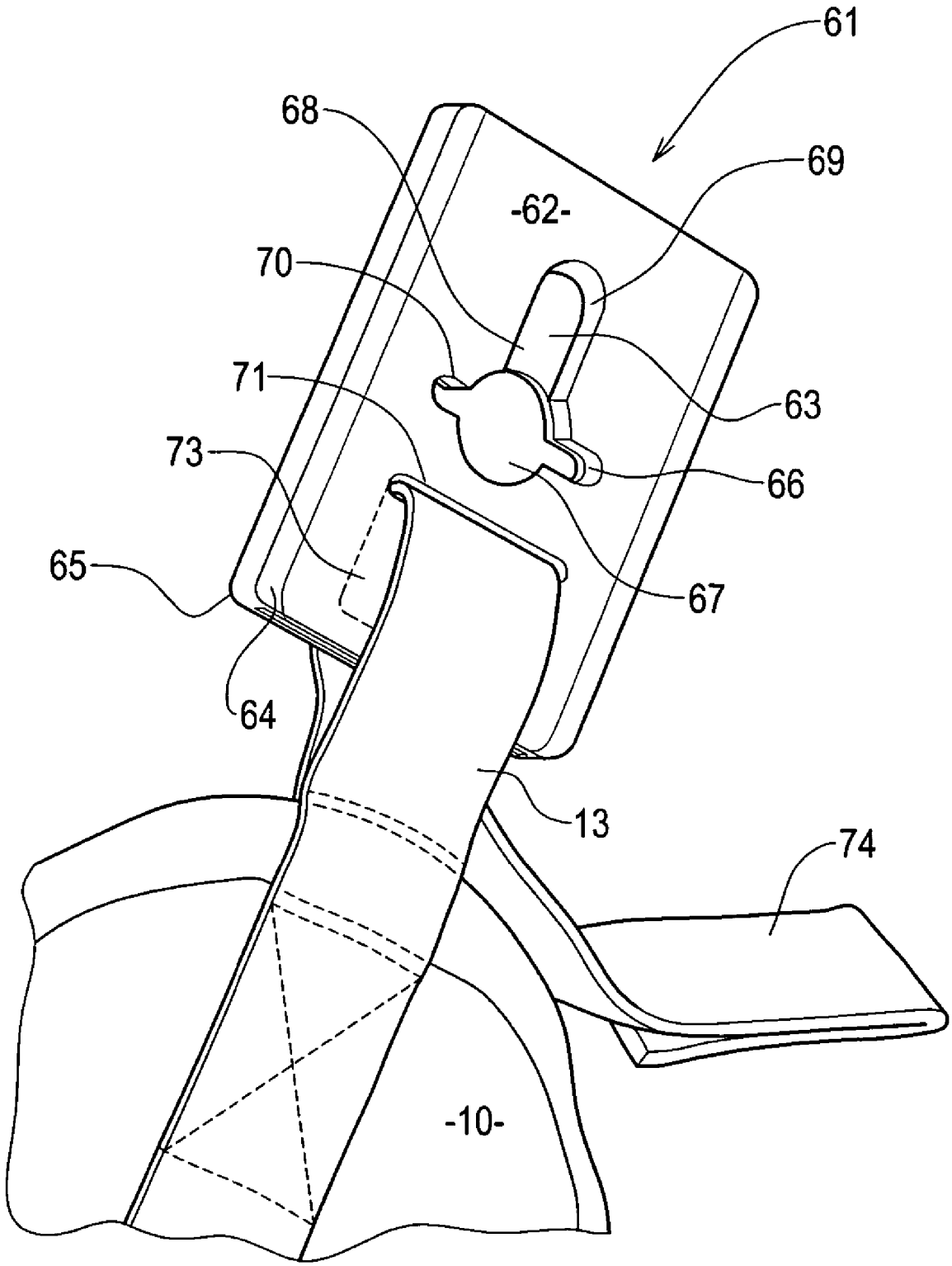
FIG. 6 is a side view of an attachment device in accordance with an alternative embodiment of the invention, in a first operative position.

FIG. 6 shows the attachment device 61 fitted to one of the connecting elements 13, which comprises a length of flexible strap material extending through the aperture 71 in the first element 62, and also through the rectangular aperture 73 in the second element 63 within the first element 62. The free ends of the flexible connecting element 13 are connected to the sling 10, being sewn thereto adjacent its edge. As depicted in FIG. 7, when the attachment device 61 is connected to the attachment formation 60 on the hoist the free end of the retaining element 74 is passed through the aperture 70 in the connecting element, but to achieve this position the following procedure has to be adopted.

The second element 63 is moveable relative to the first element 62 of the attachment device between a first position in which it is shown in FIG. 6 and a second position in which it is shown in FIG. 7. In the first position, the opening 72 in the second element 63 aligns with the lowermost portion of the slot 66 in the first element 62, whilst the aperture 70 in the first element 62 is blocked by the second element 63. The aperture 71 in the first element 62 lies adjacent the top of the square aperture 73 in the second element 63. In this position, the head 60*b* of the attachment formation 60 is able to be passed through the aligned opening 72 and the lower portion of slot 66.

Then the connecting element 13 and hence the first element 62 of the attachment device can be pulled downwardly relative to the second element 63 of the attachment device. The position shown in FIG. 7 is attained, in which the body 60*a* of the attachment formation 60 lies in the slightly enlarged upper end 69 of the slot 66 in the second element. The remainder of the slot 66 in the second element 63 is blocked by the element 63 beneath its opening 72. The top of the square aperture 73 in the element 63 aligns with the aperture 70 in the first element 62, so that the free end of the safety retaining element 74 can be passed through the through-opening thus afforded, as shown in FIG. 7. The presence of the safety retaining element 74 at least resists and preferably altogether prevents movement of the first and second elements 62, 63 from the position shown in FIG. 7. Thus the attachment device is held captive to the attachment formation 60 with disengagement therefrom impossible unless the safety retaining element 74 is firstly moved out of the aligned aperture 70, 73.

It will be noted that in this condition the aperture 71 in the first element 62 aligns with the bottom of square aperture 73 in the second element 63, so the load on the connecting element 13 is born by both the first and second elements 62, 63.

The part of the second element 63 which protrudes above the first element 62 may be provided with a visible indication of its being in that position (e.g. a noticeable color or a printed indication), such as indicated at 76 in FIG. 7, to indicate that the attachment device has reached a safely attached condition. A detent, catch or the like, as indicated at 77, may be provided operable between the first and second elements 62, 63 further to provide security against their moving from the relative position shown in FIG. 7. The safety retaining element 74 may be a bright color or otherwise be arranged to be readily noticeable when it is in position as shown in FIG. 7, so the safely attached condition of the attachment device is visible at a glance.

The invention thus provides an attachment device which is easy to operate and provides a high degree of safety in use.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An attachment device for attaching a sling to a hoist by engaging with an attachment formation on the hoist, which attachment formation comprises a body part and enlarged head, the attachment device being adapted to have a sling-connecting element attached to it and comprising first and second elements disposed in face to face relationship with one another and moveable relative to one another between first and second positions;

the first element comprising a slot having a first portion through which the head of the attachment formation will pass and a second portion extending from the first portion and through which the body of the attachment portion can pass but through which the head will not pass;

the second element having an opening through which the head of the attachment formation can pass and which aligns with the first portion of the slot in the first element when the first and second elements are in their first relative position and which aligns with the second portion of the slot when the first and second elements are in their second relative position, in which position the second element blocks the first portion of the slot in the first element;

the first and second elements having apertures which are able to receive a retaining element when the first and second elements are in their second relative position to hold them in such position, the apertures registering with one another when the elements are in their second relative position but do not register when the elements are in their first relative position.

2. An attachment device according to claim 1 having a sling-connecting element comprising a flexible strap element.

3. An attachment device according to claim 2 comprising an additional length of the material of the sling-connecting element, constituting the retaining element.

4. An attachment device according to claim 3 wherein said material constituting the retaining element has a distinctive color or other aspect of its appearance.

5. An attachment device according to claim 1 wherein, when the first and second elements are in their second relative position, a part of the second element extends outwardly beyond a part of the first element.

6. An attachment device according to claim 5 wherein said part of the second element is colored or bears some indicia to provide a visual indication that the first and second element are in their second position relative to one another.

7. An attachment device according to claim 1 wherein the apertures in the first and second elements are adapted to receive a retaining element in the form of a free end part of a length of flexible strap material.

8. An attachment device according to claim 1 wherein the second element has an aperture of sufficient size to align with an aperture in the first element to receive the retaining element when the first and second elements are in their second relative position, and to align with an aperture in the first element to receive the retaining element when the first and second elements are in both their first and second relative position.

9. An attachment device according to claim 1 wherein a detent or catch is provided, operative between the first and second elements to resist relative movement there between from their second relative position to their first relative position.

10. An attachment device for attaching a sling to a hoist by enaging with an attachment formation on the hoist, which attachment formation comprises a body part and ealar enlarged head, the attachment device being adapted to have a sling-connecting element attached to it and comprising first and second elements disposed in face to face relationship with one another and moveable relative to one another between first and second positions;

the first element comprising a slot having a first portion through which the head of the attachment formation will pass and a second portion extending from the first portion and through which the body of the attachment portion can pass but through which the head will not pass;

the second element having an opening through which the head of the attachment formation can pass and which aligns with the first portion of the slot in the first element when the first and second elements are in their first relative position and which aligns with the second portion of the slot when the first and second elements are in their second relative position, in which position the second element blocks the first portion of the slot in the first element;

the first and second elements having apertures which are in alignment with one another to receive the retaining element when the first and second elements are in both their first and their second positions relative to one another and in positions therebetween.

11. An attachment for attaching a sling to a hoist by engaging with an attachment formation on the hoist which attachment formation comprises a body part and enlarged head, the attachment device being adapted to have a sling-connecting element attached to it and comprising first and second elements disposed in face to face relationship with one another and moveable relative to one another between first and second positions;

the first element comprising a slot having a first portion through which the head of the attachment formation will pass and a second portion extending from the first portion and through which the body of the attachment portion can pass but through which the head will not pass;

the second element having an opening through which the head of the attachment formation can pass and which aliens with the first portion of the slot in the first element when the first and second elements are in their first relative position and which aligns with the second portion of the slot when the first and second elements are in their second relative position in which position the second element blocks the first portion of the slot in the first element;

the first and second elements having formations which are able to receive a retaining element when the first and second elements are in their second relative position to hold them in such position, wherein the first element comprises two portions that are spaced parallel to one another and between which the second element is received.

12. An attachment device according to claim 11 wherein the second element is slideable linearly between the spaced parts of the first element.

13. An attachment device according to claim 11 wherein the first element is of plastics material and the second element of metal.

* * * * *

UNITED STATES PATENT AND TRADEMARK OFFICE

CERTIFICATE OF CORRECTION

PATENT NO. : 7,367,091 B2
APPLICATION NO. : 11/245932
DATED : May 6, 2008
INVENTOR(S) : Nathan McWattie et al.

It is certified that error appears in the above-identified patent and that said Letters Patent is hereby corrected as shown below:

Column 5, Line 16, delete "Loan", insert --form--

Signed and Sealed this

Fifteenth Day of July, 2008

JON W. DUDAS
*Director of the United States Patent and Trademark Office*